US006770819B2

(12) United States Patent
Patel

(10) Patent No.: US 6,770,819 B2
(45) Date of Patent: Aug. 3, 2004

(54) COMMUNICATIONS CABLES WITH OPPOSITELY TWINNED AND BUNCHED INSULATED CONDUCTORS

(75) Inventor: Mahesh Patel, Hickory, NC (US)

(73) Assignee: CommScope, Properties LLC, Hickory, NC (US)

( * ) Notice: Subject to any disclaimer, the term of this patent is extended or adjusted under 35 U.S.C. 154(b) by 0 days.

(21) Appl. No.: 10/074,741

(22) Filed: Feb. 12, 2002

(65) Prior Publication Data

US 2003/0150638 A1 Aug. 14, 2003

(51) Int. Cl.[7] ..... H01B 11/04
(52) U.S. Cl. ..... 174/113 R
(58) Field of Search ..... 174/113 R, 113 C, 174/131 A, 27, 36, 110 F

(56) References Cited

U.S. PATENT DOCUMENTS 4,970,112 A * 11/1990 Hayami ..... 174/110 F
5,659,152 A * 8/1997 Horie et al. ..... 174/113 R
5,789,711 A * 8/1998 Gaeris et al. ..... 174/113 C
6,355,876 B1 * 3/2002 Morimoto ..... 174/113 R
6,452,094 B2 * 9/2002 Donner et al. ..... 174/113 R

FOREIGN PATENT DOCUMENTS

DE 26 18 907 11/1977
DE 196 36 286 3/1998

OTHER PUBLICATIONS

EPO Search Report for EP 03 00 3053 dated Oct. 20, 2003.

* cited by examiner

*Primary Examiner*—Chau N. Nguyen
(74) *Attorney, Agent, or Firm*—Myers Bigel Sibley & Sajove

(57) ABSTRACT

A communications cable comprises an elongate cable jacket having an internal cavity and a plurality of twisted pairs of insulated conductors disposed in the internal cavity of the cable jacket, each of the conductors being insulated with a polymeric layer. Each of the insulated conductors within each of the twisted pairs of conductors defines a twinning helix having a first rotative direction, and each of the twisted pairs defines a bunching helix having a second rotative direction, the second rotative direction being opposite that of the first rotative direction. In this configuration, the communications cable can provide acceptable crosstalk and attenuation performance, even with foamed insulators that have demonstrated unacceptable performance when twinned and bunched in the same rotative direction.

28 Claims, 11 Drawing Sheets

COMMUNICATIONS CABLES WITH OPPOSITELY TWINNED AND BUNCHED INSULATED CONDUCTORS

FIELD OF THE INVENTION

The present invention relates broadly to communications cable and, more particularly, to communications cable containing at least one twisted pair of insulated conductors.

BACKGROUND OF THE INVENTION

Insulated conductors such as those used in communications cable are often provided as twisted pairs of insulated conductors having two insulated conductors twisted, or "twinned", about each other to form a dual conductor group. A typical assembly for these communications cables comprises two or more twisted pairs of insulated conductors "bunched" together (i.e., further twisted and in some instances captured with a binder thread or cable) and contained in a cable jacket. The twisting and bundling of the conductors can facilitate the installation of the cable and connection between insulated conductors. Twisted pair conductors are commonly used in applications such as local area network (LAN) cables and wireless cable network architectures.

One problem associated with communications cable produced with the conventional twisted pair assembly is that crosstalk can occur between twisted pairs of insulated conductors that can negatively affect the signals transmitted by these conductors. Crosstalk may especially present a problem in high frequency applications because crosstalk may increase logarithmically as the frequency of the transmission increases. Some twisted pairs are sufficiently impacted by crosstalk that insulating spacers are positioned between pairs within the same cable. See, e.g., U.S. Pat. No. 5,969,295 to Boucino et al. Another technique for adjusting crosstalk performance involves twinning the conductors of different pairs so that they have different lay lengths and carefully selecting the lay length for bunching.

The insulation employed for conductors is typically a polymeric material. Exemplary insulating materials includes but are not limited to, polyvinylchloride, polyvinylchloride alloys, polyethylene, polypropylene, and flame retardant materials such as fluorinated polymers. Exemplary fluorinated polymers, include but are not limited to, fluorinated ethylene-propylene (FEP), ethylenetrifluoroethylene (ETFE), ethylene chlorotrifluoroethylene (ECTFE), perfluoroalkoxypolymers (PFA's) like tetrafluoroethylene and perfluoropropylvinylether (e.g., Teflon PFA 340), and mixtures thereof.

In an effort to reduce the weight and cost of insulation, conductors with foamed polymer insulation, and particularly foamed FEP insulation, have been constructed. The foaming process introduces air into the dielectric medium. Air having a lower dielectric constant increases the velocity of propagation (Vp). Higher Vp typically translates to improved signal transmission speed for high speed data or communications systems. However, the resulting foamed medium tends to become more susceptible to crushing during the twinning and bunching processes. Such crushing can undesirably raise the capacitance and lower the impedance of the finished cable, which can consequently degrade attenuation performance. In order to provide foamed dielectric insulation with sufficient crush resistance to provide adequate cable performance, additional dielectric material has been required, thereby negating some or all of the weight, cost and performance advantages of using a foamed dielectric. Accordingly, it would be desirable to provide a cable having a foamed dielectric with acceptable performance properties while reducing material weight and cost.

SUMMARY OF THE INVENTION

The present invention is directed to a communications cable and an associated manufacturing method therefore that can utilize foamed insulators for electrical conductors and still provide acceptable performance. According to certain embodiments of the invention, a communications cable comprises: an elongate cable jacket having an internal cavity; and a plurality of twisted pairs of insulated conductors disposed in the internal cavity of the cable jacket, each of the conductors being insulated with a polymeric layer. Each of the insulated conductors within each of the twisted pairs of conductors defines a twinning helix having a first rotative direction, and each of the twisted pairs defines a bunching helix having a second rotative direction, the second rotative direction being opposite that of the first rotative direction. In this configuration, the communications cable can provide acceptable crosstalk and attenuation performance, even with foamed insulators that have demonstrated unacceptable performance when twinned and bunched in the same rotative direction.

It is preferred that at least one, and more preferably all, of the polymeric layers are formed of a foamed polymeric material (as used herein, a "foamed" polymeric material means both foamed and foam skin materials). It is also preferred that the twinning helices have different lay lengths, and the bunching helix also has a different lay length.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein. Instead, these embodiments are provided so that this disclosure will be thorough and complete, and will fully convey the scope of the invention to those skilled in the art. It will be understood that when an element (e.g., cable jacket) is referred to as being "connected to" another element, it can be directly connected to the other element or intervening elements may also be present. In contrast, when an element is referred to as being "directly connected to" another element, there are no intervening elements present. Like numbers refer to like elements throughout. Some dimensions and thicknesses may be exaggerated for clarity.

Figure 1:
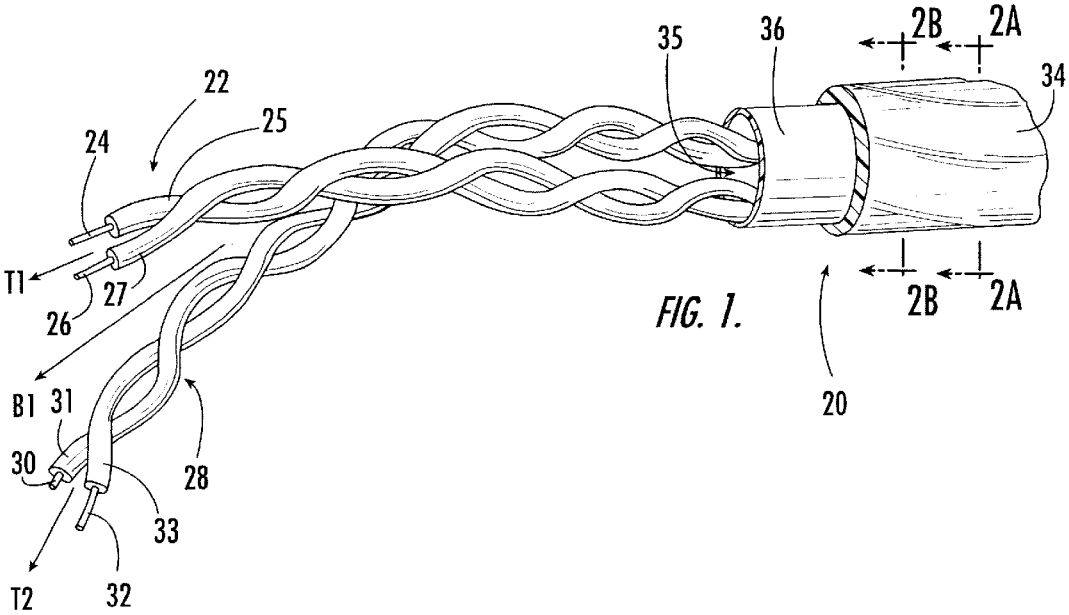
FIG. 1 is a perspective cutaway view of an embodiment of a twinned pair cable of the present invention.
Figure 2A:
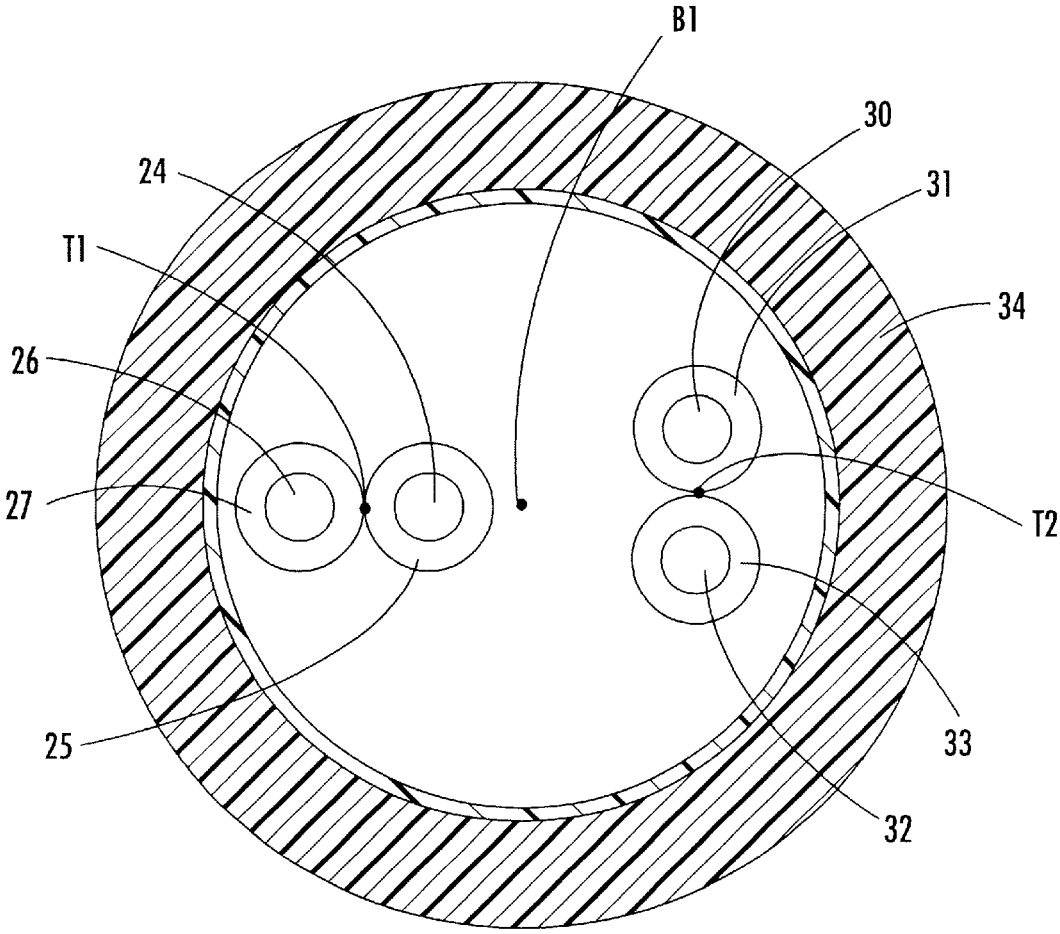
FIG. 2A is a section view of the cable of FIG. 1 taken along lines 2A—2A thereof.
Figure 2B:
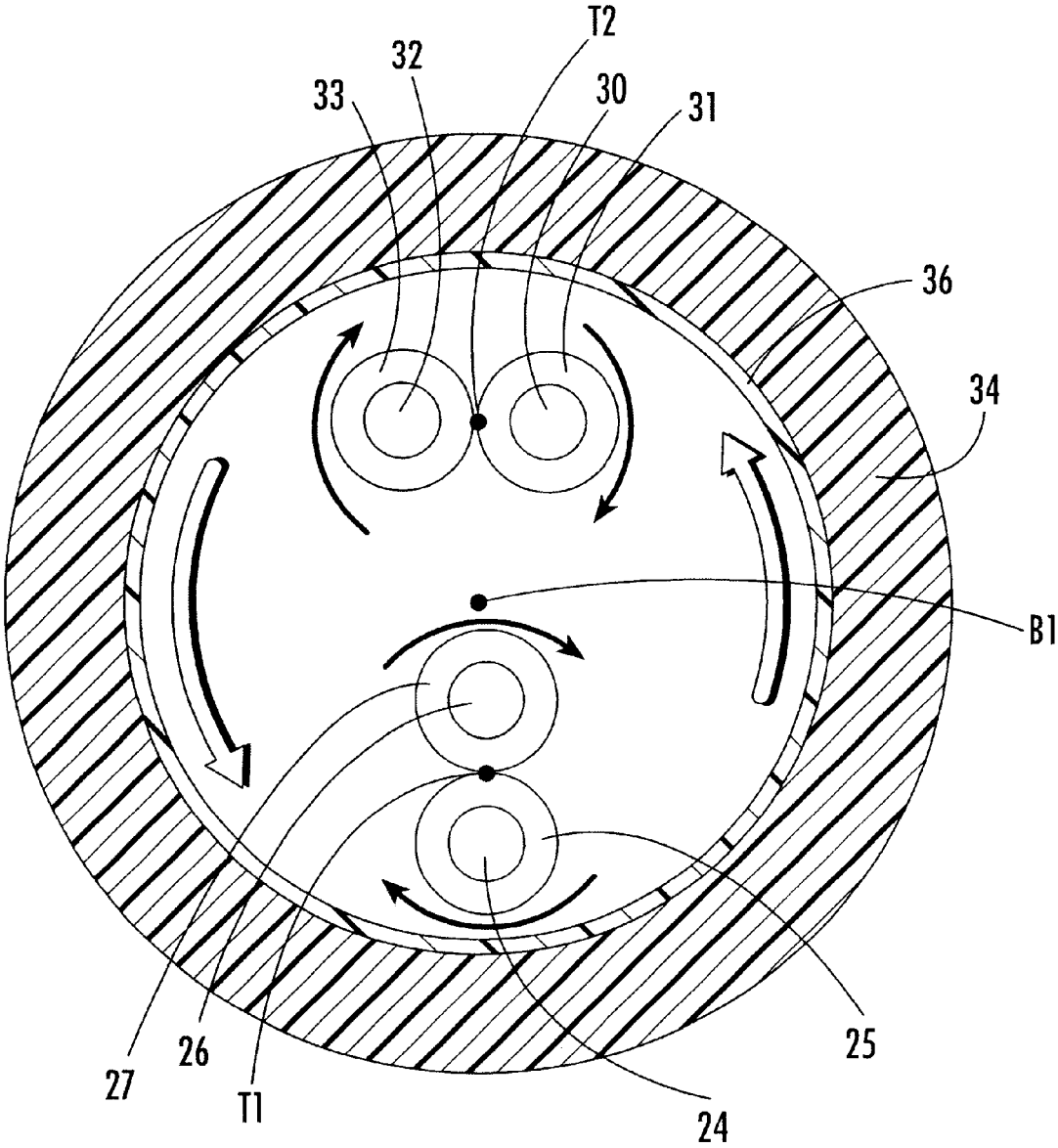
FIG. 2B is a section view of the cable of FIG. 1 taken along lines 2B—2B thereof.

Referring now to the figures, a twinned pair cable, designated broadly at 20, is illustrated in FIGS. 1, 2A and 2B. The cable 20 comprises two twinned pairs 22, 28 of conductors, with the first pair 22 including conductors 24, 26 and the second pair 28 including conductors 30, 32. The conductors 24, 26, 30, 32 are covered with, respectively, insulators 25, 27, 31, 33. The conductors 24, 26, 30, 32 may be a metallic wire of any of the well-known metallic conductors used in wire and cable applications, such as copper, aluminum, copper-clad aluminum and/or copper-clad steel. Preferably, the wire is 18 to 26 AWG gauge.

Suitable insulating materials for the insulators 25, 27, 31, 33 include polyvinylchloride, polyvinylchloride alloys, polyethylene, polypropylene, and flame retardant materials such as fluorinated polymers. Exemplary fluorinated polymers for use in the invention include FEP, ETFE, ECTFE, PFA's, and mixtures thereof. Exemplary PFA's include copolymers of tetrafluoroethylene and perfluoropropylvinylether (e.g., Teflon PFA 340) and copolymers of tetrafluoroethylene and perfluoromethylvinylether (MFA copolymers, which are available from Ausimont S.P.A.). In addition, the material of the insulators 25, 27, 31, 33 may contain conventional additives such as pigments, nucleating agents, thermal stabilizers, acid acceptors, processing aids, and/or flame retardant compositions (e.g., antimony oxide). If desired, the insulating material may not be the same for each twisted pair 22, 28. In accordance with the present invention, some or all of the insulators 25, 27, 31, 33 may be formed of polymeric materials that have been foamed or that have a foam skin structure, such as FEP or polyethylene. Typically, these materials are foamed to a density of between about 50 and 80 percent of their solid volume.

As illustrated in FIGS. 1, 2A and 2B, the conductors 24, 26 of the pair 22 are twinned about a twin axis T1 and follow a counterclockwise twinning helix when viewed from the viewing direction indicated in FIG. 1 and from the vantage point of FIGS. 2A–2B. Likewise, the conductors 30, 32 of the pair 28 are twinned about a twin axis T2 and follow a counterclockwise twinning helix when view from the viewing direction indicated in FIG. 1 and from the vantage point of FIGS. 2A–2B. However, the pairs 22, 28 are bunched about a bunching axis B1 and follow a clockwise bunching helix when viewed from the viewing direction indicated in FIG. 1 and from the vantage point of FIGS. 2A–2B. It has been discovered that, when conductors with insulation are helically twinned in one rotative direction and helically bunched in the opposite rotative direction, there can be reduced crushing of the insulators 25, 27, 31, 33 without the expected corresponding reduction in cross-talk performance.

Typically, the pairs 22, 28 are twinned such that the "lay length" (defined as the distance along each conductor required for the conductor to travel one complete circumference of the helix) of twinning is between about 0.25 and 1.0 inches. In some embodiments, the lay lengths of the pairs 22, 28 will differ from one another (usually by about 20 to 50 percent). The pairs 22, 28 are typically bunched so that the lay length of bunching is between about 2.5 and 6.0 inches.

Those skilled in this art will recognize that, although the cable 20 is illustrated with pairs 22, 28 being twinned in a counterclockwise helix and being bunched in a clockwise helix, cables can also be constructed with pairs being twinned in a clockwise helix and bunched in a counterclockwise helix.

The pairs 22, 28 are enclosed within the cavity 35 of a jacket 34. Preferably, the jacket 34 is made of a flexible polymer material and is formed by melt extrusion. As will be understood by those of skill in the art, any of the polymer materials conventionally used in cable construction may be suitably employed; these include, but are not limited to, polyvinylchloride, polyvinylchloride alloys, polyethylene, polypropylene and flame retardant materials such as FEP or another fluorinated polymer. Moreover, other materials and/or fabrication methods may be used. Preferably, the cable jacket 34 is extruded to a thickness of between 15 and 25 mils (thousandths of an inch), which may facilitate stripping the cable jacket 34 away from the twisted pairs 22, 28. However, other dimensions may be used. The jacket may overlie one or more optional shielding layers 36; these are typically formed of a wide variety of known conductive and/or nonconductive materials such as nonconductive polymeric tape, conductive tape, braid, a combination of nonconductive polymeric tape, conductive tape and/or braid, and/or other such materials as will be understood to one of skill in the art using conventional fabrication techniques.

The cable 20 may be used in a variety of computer, communication, and telecommuncation environments, including residential and commercial buildings.

Figure 5:
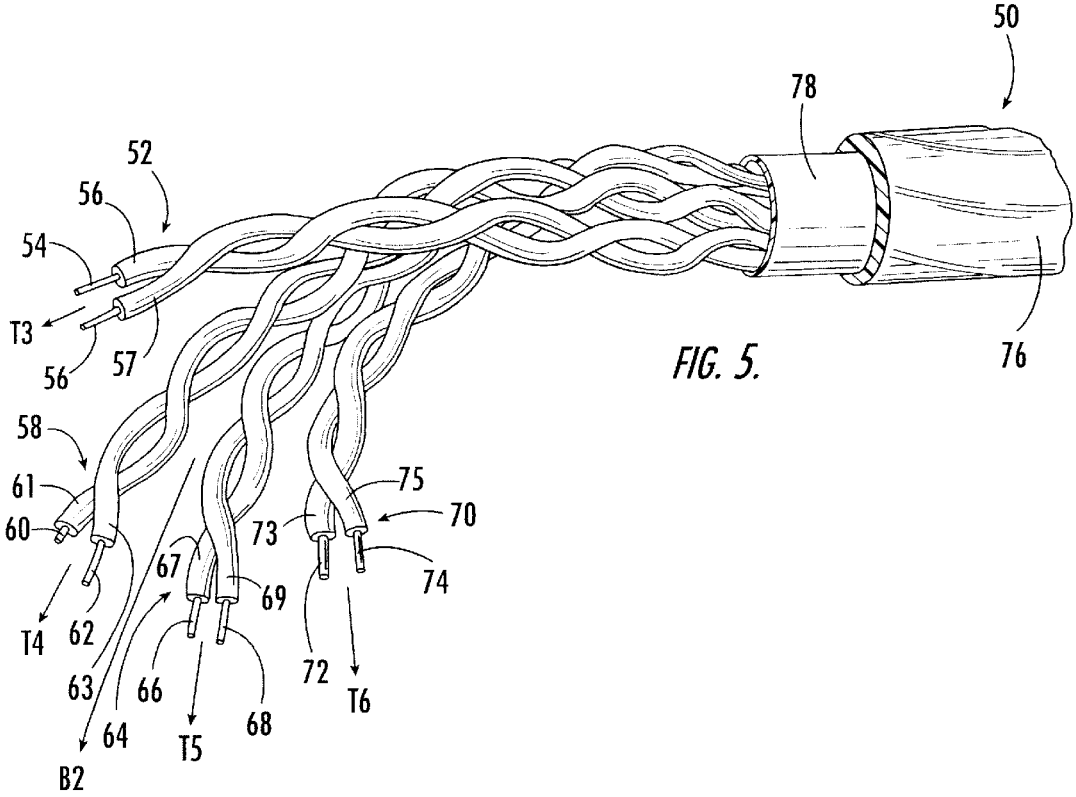
FIG. 5 is a perspective cutaway view of another embodiment of a twinned pair cable of the present invention.

Another cable embodiment of the present invention, designated broadly at 50, is illustrated in FIG. 5. The cable 50 includes four twisted conductor pairs 52, 58, 64, 70, which comprise, respectively, conductors 54 and 56 (insulated by insulators 55 and 57), conductors 60 and 62 (insulated by insulators 61 and 63), conductors 66 and 68 (insulated by insulators 67 and 69), and conductors 72 and 74 (insulated by insulators 73 and 75). Like the cable 20 illustrated in FIGS. 1, 2A and 2B, the pairs 52, 58, 64, 70 are covered by a jacket 76 and an optional shielding layer 78. The description of the materials appropriate for use in the conductors, insulators, jacket and shield of the cable 20 are equally applicable to these components of the cable 50 and need not be repeated here.

The pairs 52, 58, 64, 70 are twinned such that they form clockwise helices along their respective twinning axes T3, T4, T5, T6, and are bunched such that they form counterclockwise helices along the bunching axis B2. Lay lengths of the twinning and bunching helices are as described above for the cable 20.

Figure 3:
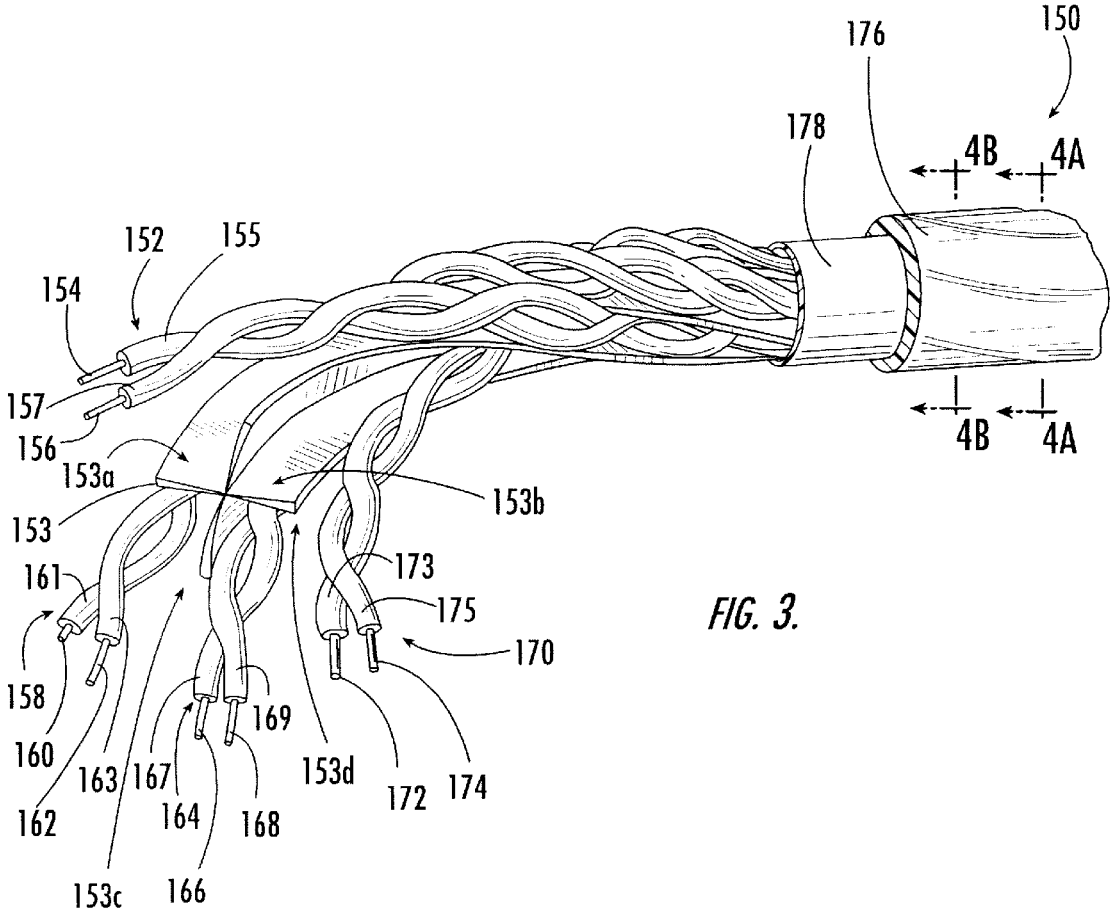
FIG. 3 is a perspective cutaway view of another embodiment of a twinned pair cable of the present invention, wherein the cable includes an insulating spacer.
Figure 4A:
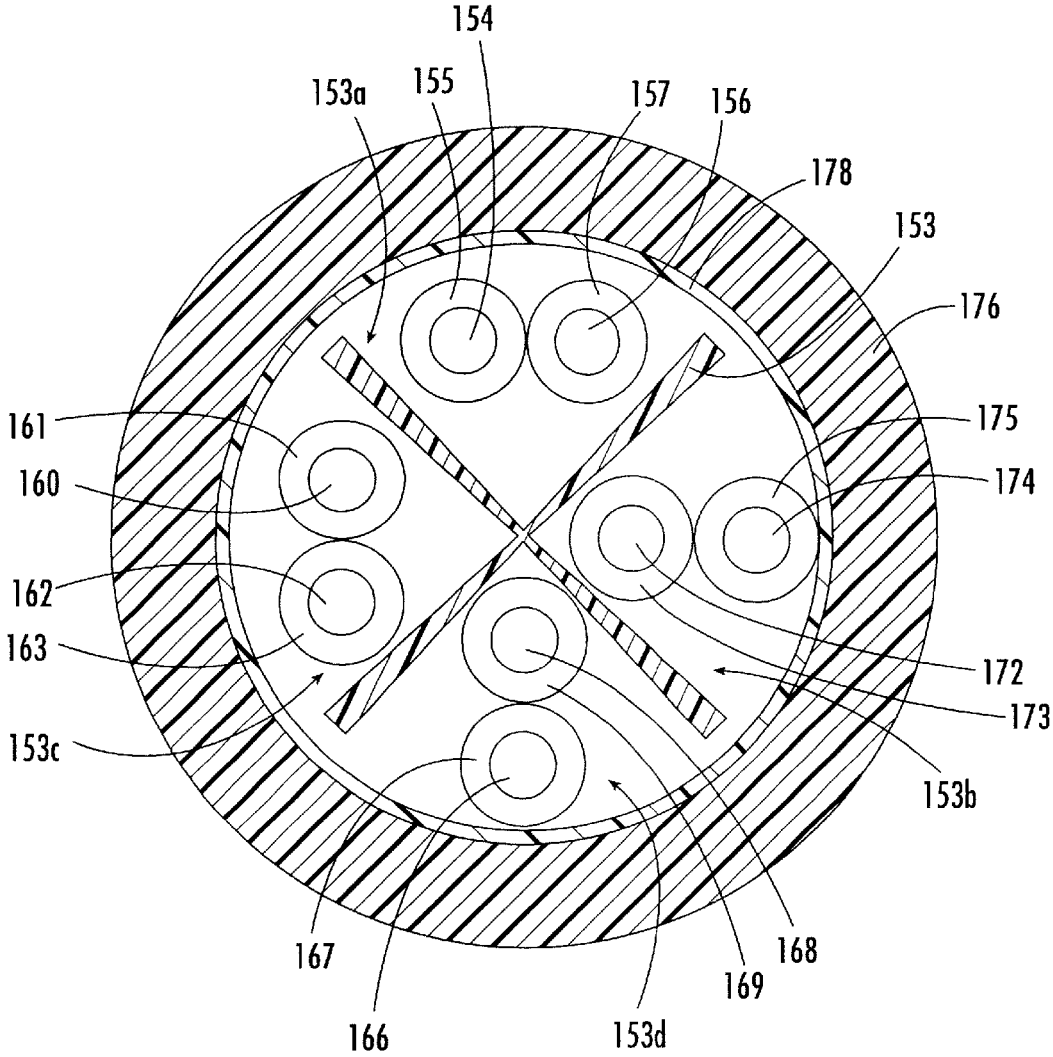
FIG. 4A is a section view of the cable of FIG. 3 taken along lines 4A—4A thereof.
Figure 4B:
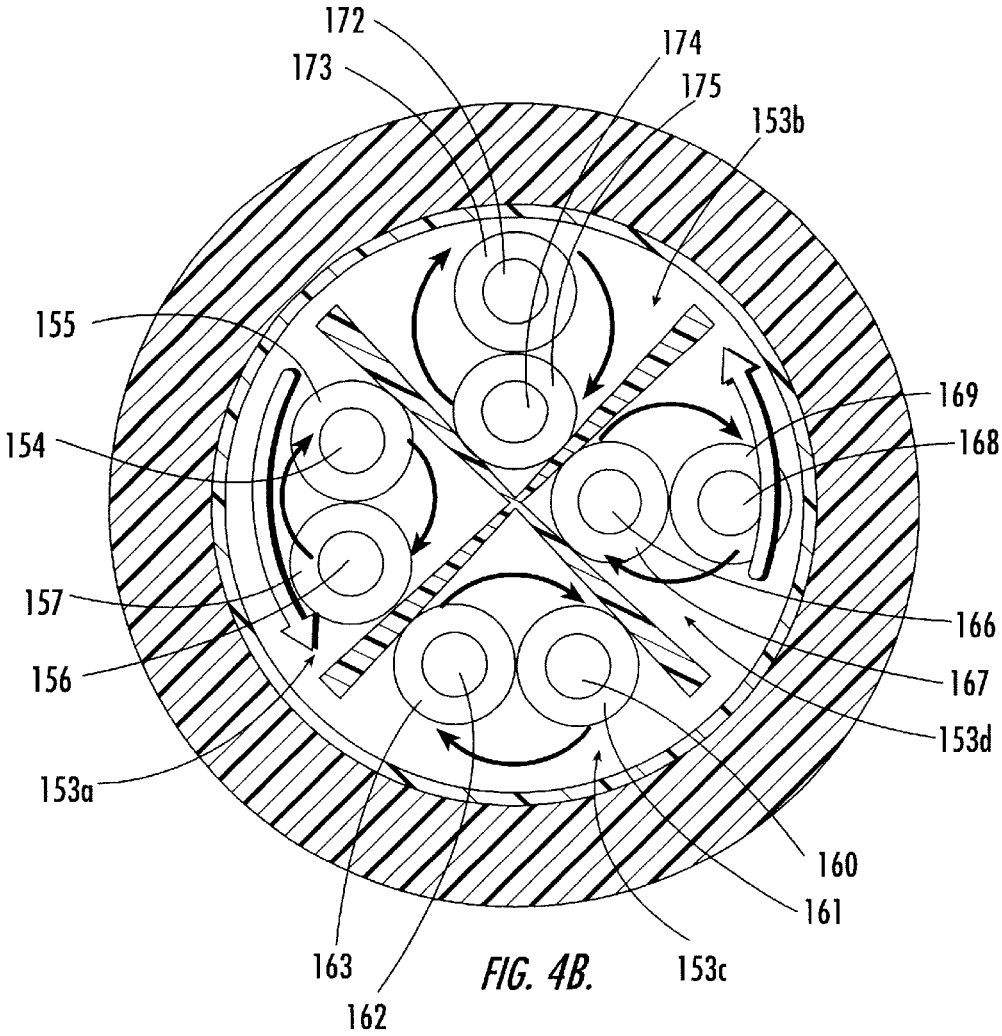
FIG. 4B is a section view of the cable of FIG. 3 taken along lines 4B—4B thereof.

A further cable embodiment of the present invention, designated broadly at 150, is illustrated in FIGS. 3, 4A and 4B. The cable 150 includes four twisted conductor pairs 152, 158, 164, 170 which comprise, respectively, conductors 154 and 156 (insulated by insulators 155 and 157), conductors 160 and 162 (insulated by insulators 161 and 163), conductors 166 and 168 (insulated by insulators 167 and 169), and conductors 172 and 174 (insulated by insulators 173 and 175). The cable 150 also includes a jacket 176 and an optional shielding layer 178. The discussions hereinabove regarding the materials and construction of the conductors, insulators, jacket and shield layers are equally applicable to the cable 150 and need not be repeated here.

Unlike the cable 50, the cable 150 also includes a spacer 151 that extends the length of the cable 150 and separates the internal cavity of the cable 150 into four compartments 153*a*, 153*b*, 153*c*, 153*d*. Each of the pairs 152, 158, 164, 170 resides in a respective one of the compartments 153*a*, 153*b*, 153*c*, 153*d*. The spacer 151 is typically included in a cable in order to regulate the distance between twisted pairs, which in turn can render crosstalk performance more consistent. Suitable different spacer configurations and materials are discussed in detail in U.S. Pat. No. 5,789,711 to Gaeris et al., U.S. Pat. No. 5,969,295 to Boucino et al. and co-pending and co-assigned U.S. patent application Ser. No. 09/591,349, filed Jun. 9, 2000 and entitled Communications Cables with Isolators; the contents of each of these documents are hereby incorporated herein by reference in their entireties.

The invention will now be described in great detail in the following non-limiting example.

EXAMPLE 1

Testing was conducted comparing the performance of cables employing oppositely twinned and bunched conductors with cables having similarly twinned and bunched conductors.

Two cable samples were constructed, each having four twisted pairs of insulated conductors and having the specifications set forth in Table 1.

TABLE 1

| Property | Value |
|---|---|
| Conductor Dimensions | 24 gauge |
| Conductor Material | AWG copper wire |
| Insulator Material | 3 pairs foam/skin FEP; 1 pair foam/skin PE |
| Insulator Thickness | 0.007 in |
| Insulator Coaxial Capacitance | FEP 52 min., 57 max; PB 61 (pf/ft) |
| Cable Length | 328 ft |
| Jacket Material | PVC Alloy (plenum rated) |

The twisted pairs of each cable were twinned in a counterclockwise direction at a lay length of between 0.45 and 0.8 inches. One cable (Cable 1) was bunched in a clockwise direction at a lay length of 6 inches (such that the twinning and bunching were in opposite rotative directions), and the other cable (Cable 2) was bunched in a counterclockwise direction at a lay length of 6 inches (such that twinning and bunching were in the same rotative direction). The cables were evaluated under testing conditions set forth in ASTM-D4566-2000.

Figure 6:
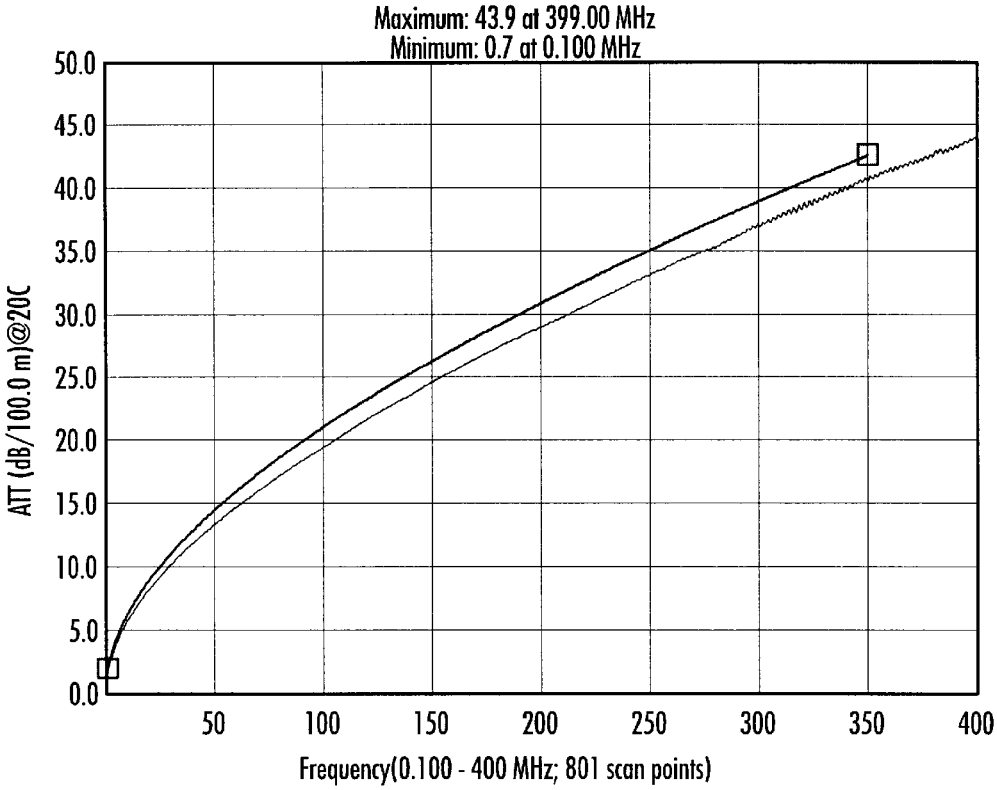
FIG. 6 is a graph plotting attenuation as a function of frequency for a cable sample twinned in a counterclockwise direction and bunched in a clockwise direction.
Figure 7:
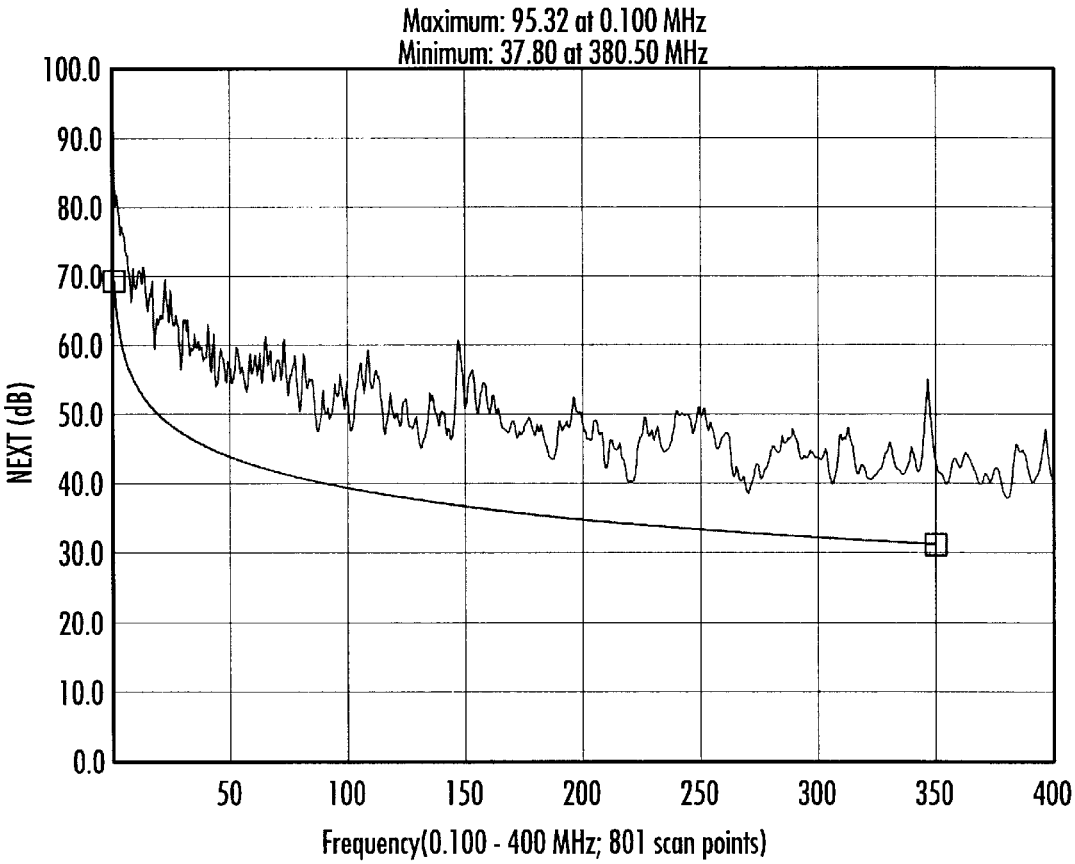
FIG. 7 is a graph plotting near end crosstalk as a function of frequency for a cable sample twinned in a counterclockwise direction and bunched in a clockwise direction.
Figure 8:
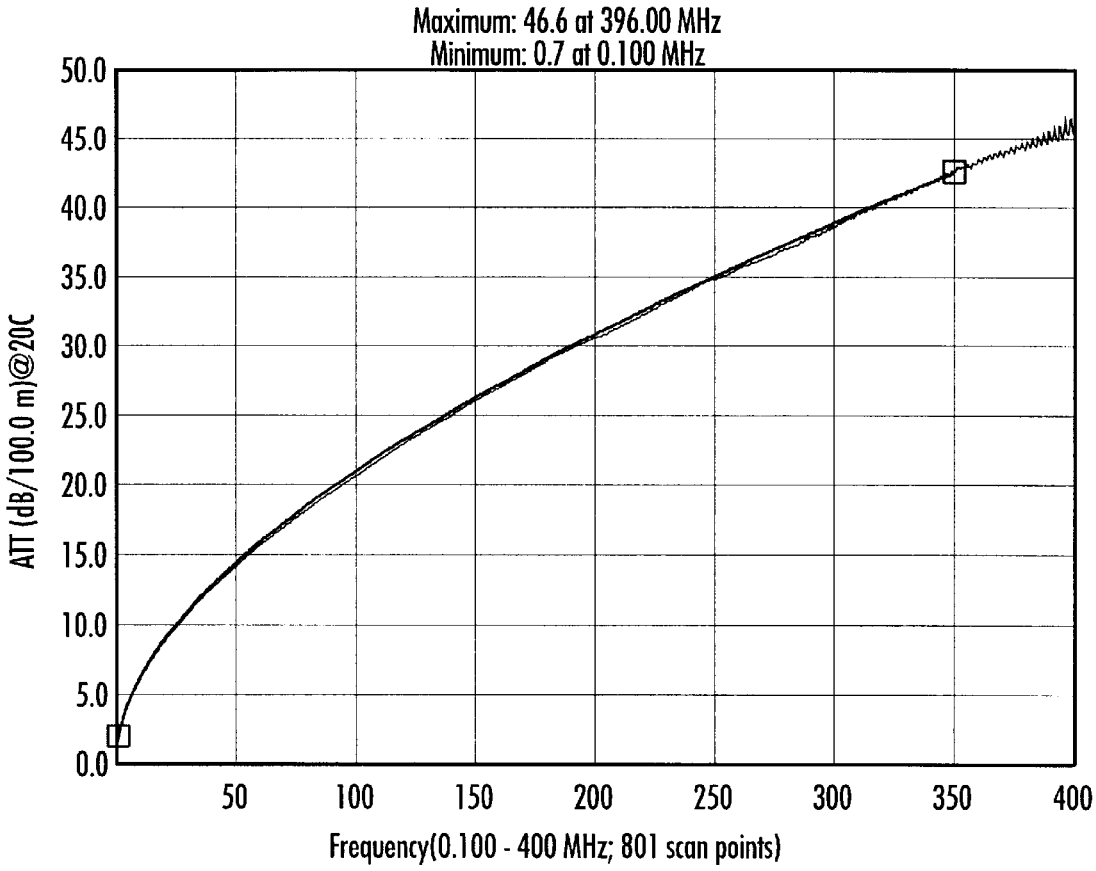
FIG. 8 is a graph plotting attenuation as a function of frequency for a cable sample twinned in a counterclockwise direction and bunched in a counterclockwise direction.
Figure 9:
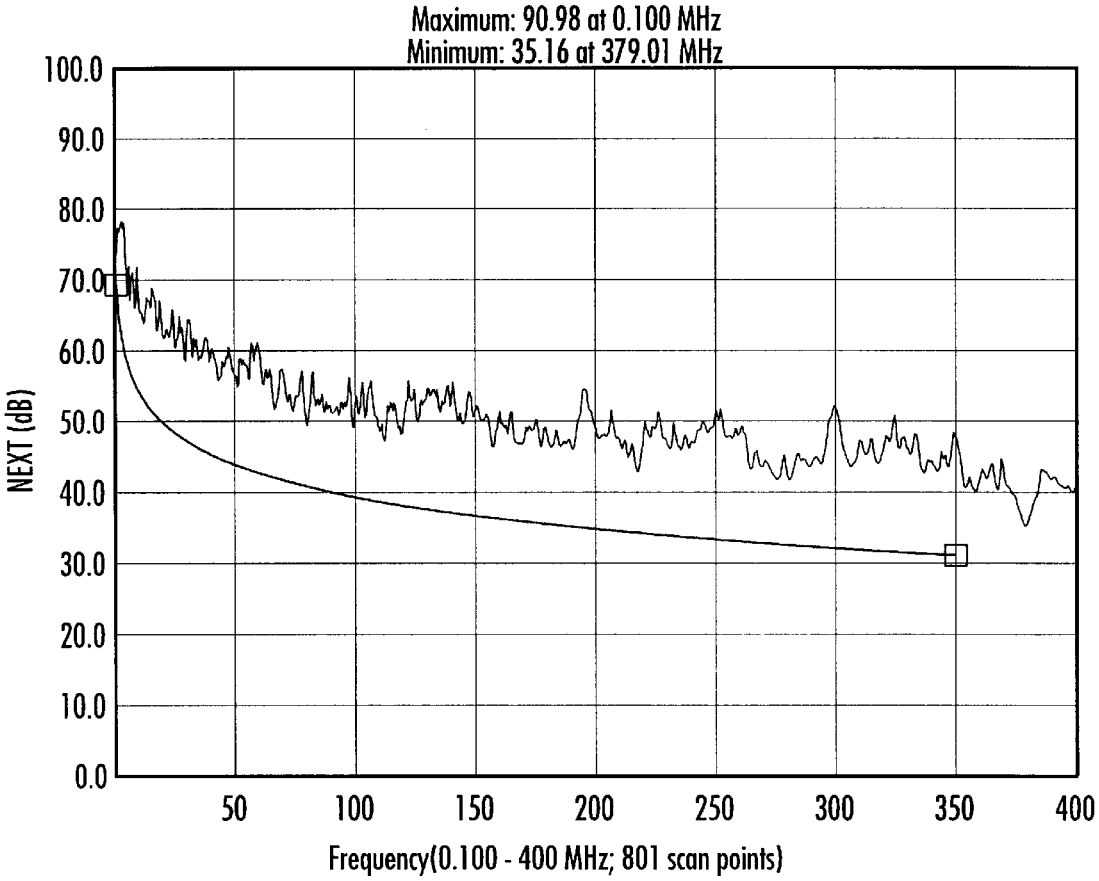
FIG. 9 is a graph plotting near end crosstalk as a function of frequency for a cable sample twinned in a counterclockwise direction and bunched in a counterclockwise direction.

Results of the evaluations are set forth in FIGS. 6–9. FIGS. 6 and 7 are graphs illustrating the performance of Cable 1. FIG. 6 is a plot of cable attenuation as a function of frequency of Cable 1 and the permissible attenuation per specification. FIG. 6 demonstrates that the plot of Cable 1 falls below the specification (i.e., is acceptable) for attenuation performance. FIG. 7 is a plot of near end crosstalk as a function of frequency for Cable 1 and specification. FIG. 7 shows that the plot for Cable 1 is positioned above the specification curve, thereby indicating acceptable performance. These results compare favorably to FIGS. 8 and 9, which show that Cable 2, while having acceptable crosstalk performance, was not able to meet the specification for attenuation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications cable, comprising:

an elongate cable jacket having an internal cavity; and a plurality of twisted pairs of insulated conductors disposed in the internal cavity of the cable jacket, each of the conductors being insulated with a foamed polymeric layer foamed to a density of between about 50 and 80 percent of that of the solid polymeric material;

wherein each of the twisted pairs of conductors defines a twinning helix having a first rotative direction; and wherein the twisted pairs define a bunching helix having a second rotative direction, the second rotative direction being opposite that of the first rotative direction.

2. The communications cable defined in claim 1, wherein the polymeric material is selected from the group consisting of FEP and polyethylene.

3. The communications cable defined in claim 1, wherein the plurality of twisted pairs of insulated conductors comprises four pairs of insulated conductors.

4. The communications cable defined in claim 1, wherein lay lengths of the twinning helices defined by the insulated conductors are between about 0.25 and 1.0 inches.

5. The communications cable defined in claim 4, wherein a lay length of the bunching helix is between about 2.5 and 8.0 inches.

6. The communications cable defined in claim 1, wherein each of the twinning helices has a different lay length.

7. The communications cable defined in claim 1, further comprising an elongate spacer that divides the internal cavity into compartments, each of the twisted pairs residing in a separate compartment.

8. The communications cable defined in claim 1, further comprising a shield layer underlying the cable jacket.

9. A communications cable, comprising:

an elongate cable jacket having an internal cavity; and a plurality of twisted pairs of insulated conductors disposed in the internal cavity of the cable jacket, each of the conductors being insulated with a foamed polymeric layer;

wherein each of the twisted pairs of conductors defines a twinning helix having a first rotative direction, each of the twinning helices having a different lay length; and wherein the twisted pairs define a bunching helix having a second rotative direction, the second rotative direction being opposite that of the first rotative direction, the bunching helix having a different lay length than any of those of the twinning helices.

10. The communications cable defined in claim 9, wherein the polymeric material is selected from the group consisting of FEP and polyethylene.

11. The communications cable defined in claim 9, wherein the foamed polymeric material is foamed to a density of between about 20 and 50 percent of that of the solid polymeric material.

12. The communications cable defined in claim 9, wherein the plurality of twisted pairs of insulated conductors comprises four pairs of insulated conductors.

13. The communications cable defined in claim 9, further comprising an elongate spacer that divides the internal cavity into compartments, each of the twisted pairs residing in a separate compartment.

14. The communications cable defined in claim 9, further comprising a shield layer underlying the cable jacket.

15. A communications cable, comprising:

an elongate cable jacket having an internal cavity; and a plurality of twisted pairs of insulated conductors disposed in the internal cavity of the cable jacket, each of the conductors being insulated with a polymeric layer, at least one of the polymeric layers comprising a foamed polymeric material;

wherein each of the twisted pairs of conductors defines a twinning helix having a first rotative direction; and wherein the twisted pairs define a bunching helix having a second rotative direction, the second rotative direction being opposite that of the first rotative direction.

16. The communications cable defined in claim 15, wherein the polymeric material is selected from the group consisting of FEP and polyethylene.

17. The communications cable defined in claim 15, wherein the foamed polymeric material is foamed to a density of between 50 and 80 percent of that of a solid polymeric material.

18. The communications cable defined in claim 15, wherein the plurality of twisted pairs of insulated conductors comprises four pairs of insulated conductors.

19. The communications cable defined in claim 15, wherein lay lengths of the twinning helices defined by the insulated conductors are between about 0.25 and 1.0 inches.

20. The communications cable defined in claim 18, wherein a lay length of the bunching helix is between about 2.5 and 8.0 inches.

21. The communications cable defined in claim 15, wherein each of the twinning helices has a different lay length.

22. The communications cable defined in claim 15, further comprising an elongate spacer that divides the internal cavity into compartments, each of the twisted pairs residing in a separate compartment.

23. The communications cable defined in claim 15, further comprising a shield layer underlying the cable jacket.

24. A method of manufacturing a communications cable, comprising:

(a) twisting two insulated conductors about a twinning axis to form a helical twisted conductor pair, the helix thereof having a first rotative direction, the insulated conductors being insulated with a foamed polyermic material;

(b) repeating step (a) to form a predetermined number of helical twisted conductor pairs, each of the helices of the helical twisted conductor pairs having the first rotative direction; and (c) bunching the predetermined number of helical twisted conductor pairs about a bunching axis to form a helical bunch of twisted conductor pairs, the helix formed by the bunch of twisted conductor pairs having a second rotative direction opposite that of the first rotative direction.

25. The method defined in claim 24, further comprising enclosing the bunch of twisted conductor pairs within a cable jacket.

26. The method defined in claim 24, wherein the foamed polymeric material is selected from the group consisting of FEP and polyethylene.

27. The method defined in claim 24, wherein lay lengths of the helices of each of the twisted conductor pairs are different.

28. The method defined in claim 27, wherein a lay length of the helix of the bunch of twisted conductor pairs has a lay length that differs from that any of the lay lengths of the twisted conductor pairs.

* * * * *

UNITED STATES PATENT AND TRADEMARK OFFICE

CERTIFICATE OF CORRECTION

PATENT NO. : 6,770,819 B2
DATED : August 3, 2004
INVENTOR(S) : Patel

It is certified that error appears in the above-identified patent and that said Letters Patent is hereby corrected as shown below:

Column 7,
Line 25, should read -- density of between 20 and 50 percent of that of a solid --
Line 33, should read -- 20. The communications cable defined in claim 19, --

Signed and Sealed this

Twenty-eighth Day of December, 2004

JON W. DUDAS
*Director of the United States Patent and Trademark Office*